US007082857B1

(12) United States Patent
Hoffman

(10) Patent No.: US 7,082,857 B1
(45) Date of Patent: Aug. 1, 2006

(54) SLIDING RAIL CONTAINMENT DEVICE FOR FLEXIBLE COLLATED SCREWS USED WITH A TOP FEED SCREW DRIVING TOOL

(75) Inventor: William H. Hoffman, Cincinnati, OH (US)

(73) Assignee: Senco Products, Inc., Cincinnati, OH (US)

( * ) Notice: Subject to any disclaimer, the term of this patent is extended or adjusted under 35 U.S.C. 154(b) by 0 days.

(21) Appl. No.: 10/964,099

(22) Filed: Oct. 13, 2004

Related U.S. Application Data

(60) Provisional application No. 60/515,990, filed on Oct. 31, 2003.

(51) Int. Cl.
*B25B 17/00* (2006.01)

(52) U.S. Cl. ..... 81/57.16; 81/433; 81/434

(58) Field of Classification Search ..... 81/434, 81/433, 435, 57.31, 57.37, 57.44, 57.1; 277/136
See application file for complete search history.

(56) References Cited

U.S. PATENT DOCUMENTS

| | | | | |
|---|---|---|---|---|
| 4,014,488 | A | 3/1977 | Potucek et al. | |
| 4,370,906 | A * | 2/1983 | Gurries | 81/464 |
| 4,404,877 | A | 9/1983 | Mizuno et al. | |
| 4,774,863 | A | 10/1988 | Geist | |
| 5,083,483 | A | 1/1992 | Takagi | |
| 5,109,738 | A | 5/1992 | Farian et al. | |
| 5,144,870 | A * | 9/1992 | Nick | 81/434 |
| 5,167,174 | A | 12/1992 | Fujiyama et al. | |
| 5,337,636 | A | 8/1994 | Shea | |
| 5,402,695 | A * | 4/1995 | Hornung | 81/434 |
| D358,749 | S | 5/1995 | Matsunaga et al. | |
| 5,473,965 | A | 12/1995 | Chen | |
| D368,216 | S | 3/1996 | Hattori | |
| 5,671,645 | A * | 9/1997 | Murayama et al. | 81/434 |
| 5,687,624 | A | 11/1997 | Tsuge et al. | |
| 5,715,982 | A | 2/1998 | Adachi | |
| 5,772,096 | A | 6/1998 | Osuka et al. | |
| 5,810,239 | A | 9/1998 | Stich | |
| 5,839,332 | A * | 11/1998 | Fujiyama et al. | 81/434 |
| 5,988,026 | A | 11/1999 | Reckelhoff et al. | |
| 6,016,946 | A | 1/2000 | Phillips et al. | |
| D420,877 | S | 2/2000 | Schultz | |

(Continued)

FOREIGN PATENT DOCUMENTS

| | | |
|---|---|---|
| AU | 27254/77 | 1/1979 |

(Continued)

*Primary Examiner*—Lee D. Wilson
*Assistant Examiner*—Alvin J. Grant
(74) *Attorney, Agent, or Firm*—Frederick H. Gribbell, LLC

(57) ABSTRACT

A portable hand-held screw driving tool is provided for use with collated strips of screws. A collated strip of screws enters from an upper-rear area of the tool and runs through a pathway or slot in an elongated, movable upper guide mounted at the tool's upper housing, then to a movable slide body having that receives and indexes the collated strip so a screw can be driven by the tool. The upper guide provides containment that prevents the flexible collated strip becoming substantially misaligned while moving through the guide's slot. When the tool is actuated to drive a screw into an object, the sliding guide moves longitudinally along the top of the tool, along with the tool's front-end screw-driving mechanism. Thus the flexible collated strip is always in a relatively fixed orientation as compared to the movable front end portion of the tool.

30 Claims, 7 Drawing Sheets

U.S. PATENT DOCUMENTS

| | | | | |
|---|---|---|---|---|
| D420,879 | S | 2/2000 | Watson et al. | |
| 6,045,024 | A | 4/2000 | Phillips | |
| 6,062,113 | A * | 5/2000 | Nakano et al. | 81/434 |
| 6,158,643 | A | 12/2000 | Phillips | |
| D436,511 | S | 1/2001 | Hayakawa | |
| 6,179,192 | B1 | 1/2001 | Weinger et al. | |
| D438,079 | S | 2/2001 | Hattori | |
| D462,001 | S | 8/2002 | Bohart et al. | |
| 6,904,834 | B1 * | 6/2005 | Lin | 81/434 |
| 6,915,724 | B1 * | 7/2005 | Kigel et al. | 81/434 |

FOREIGN PATENT DOCUMENTS

| | | |
|---|---|---|
| DE | 41 19 925 | 1/1992 |
| DE | 42 08 715 | 9/1992 |
| DE | 195 26 543 | 1/1996 |
| EP | 0 058 986 | 9/1982 |
| EP | 0 623 426 | 11/1994 |

* cited by examiner

SLIDING RAIL CONTAINMENT DEVICE FOR FLEXIBLE COLLATED SCREWS USED WITH A TOP FEED SCREW DRIVING TOOL

CROSS-REFERENCE TO RELATED APPLICATIONS

The present application claims priority to provisional patent application Ser. No. 60/515,990, titled "Sliding Rail Containment System for Flexible Collated Screws," filed on Oct. 31, 2003.

TECHNICAL FIELD

The present invention relates generally to portable screw driving equipment and is particularly directed to a motorized tool of the type which receives a flexible strip of collated screws, and automatically drives individual screws from the collated strip into an object. The invention is specifically disclosed as a portable screw driving tool that receives a flexible collated strip of screws from a "top" area of the tool, and provides a means of containment so as to prevent the flexible collated strip from becoming substantially misaligned, which could lead to the strip bunching up or becoming tangled. The collated strip is directed into a pathway (or slot) of a sliding rail sub-assembly, and the strip moves through the pathway/slot until the strip reaches the screw-driving front position of the tool. The pathway/slot contains the flexible strip as the strip moves therethrough, regardless of the orientation of the screw driving tool with respect to the ground, as a source of gravity.

The screw driving tool has the sliding rail sub-assembly mounted along an upper or top area of the tool (when the tool is positioned in a horizontal direction). When the tool is actuated to drive a screw into an object, the sliding rail moves longitudinally along the top of the tool, along with the tool's front-end screw-driving mechanism. Thus the flexible collated strip is always in a relatively fixed orientation as compared to the front end portion of the tool, as well as the sliding rail portion. This assists in preventing the flexible strip from becoming misaligned, by bunching or becoming tangled, and tends to eliminate screw misfeeds.

BACKGROUND OF THE INVENTION

Portable hand-held screw driving tools have been available from Senco Products, Inc. for several years. Some of the previous tools sold by Senco were used with screw lengths in the range of one inch to two inches. Many of these tools have been "top feed" tools, in which a flexible collated strip of screws was fed into the top portion of the tool toward the front or nose of the tool, where the individual screws are taken from the collated plastic strip and driven into a solid object.

The flexible collated screw strips can be difficult to manage, and at times it is difficult to prevent the screws from bunching or tangling during a driving sequence. For example, this tangling/bunching phenomena can occur when the collated screws have been fed into a slide body mechanism; once the driving mechanism has been actuated, the screws could have a tendency to cross over one another, perhaps creating a jam or a misfeed. This may occur whether the tool is being driven in a horizontal or a vertical plane (or at other angles).

In some of the earlier tools sold by Senco, the collated strip of screws may not tend to readily become bunched or tangled during drive sequences of the tool, perhaps because the screws were not very long. For example, two-inch screws have been used in some Senco tools, such as those sold under the Model Numbers DS200, DS200-D2, and DS200-D4. On the other hand, some earlier Senco tools used three-inch screws, such as Senco Model Numbers DS300 and DS300-D2.

In some of the earlier Senco top-feed screw driving tools, there was a fixed "top" guide rail that fed the collated strip of screws to the front (drive portion) of the tool. An example of this configuration is the Senco tool Model Number DS200-D4. In some of the other earlier Senco top-feed screw driving tools, there was a movable "top" guide rail that fed the collated strip of screws to the front (drive portion) of the tool. An example of this configuration is the Senco tool Model Number DS300-D2. However, the guide rail on the model DS300-D2 was spaced-apart from the top of the tool main body, and a rigid metal bracket is used to help support the guide rail and to help direct the collated strip of screws to the front end of the tool.

It would be an improvement to provide a top-feed portable hand-held screw driving tool that could be used with longer screws that were provided on a collated strip, but at the same time to provide a means for preventing the collated strip from becoming misaligned, by sagging or otherwise bunching or becoming tangled.

SUMMARY OF THE INVENTION

Accordingly, it is an advantage of the present invention to provide a portable hand-held screw driving tool that can feed a collated strip of screws from the top portion of the tool to the nose of the tool in a manner that prevents the flexible collated strip from becoming substantially misaligned, e.g., from substantially bunching, tangling, or sagging.

It is another advantage of the present invention to provide a portable hand-held screw driving tool that has a movable guide member mounted along the upper portion of the tool that feeds a flexible collated strip of screws therethrough, then passes the collated strip of screws to a front or nose portion of the tool while keeping the collated strip of screws from becoming substantially misaligned, e.g., from substantially sagging, bunching, or becoming tangled.

It is yet another advantage of the present invention to provide a portable hand-held screw driving tool that accepts a flexible collated strip of rather lengthy screws through a slidable guide member that mounts on the upper portion of the tool, in which the upper guide member includes a longitudinal slot or pathway that feeds the flexible collated strip of screws toward a front driving portion of the tool, and that keeps the strip of screws from becoming substantially misaligned while the tool is operated to drive the screw at the nose portion of the tool, in which the movable guide member can slide in a longitudinal motion along with the nose portion of the tool during the driving operation of the tool.

It is still another advantage of the present invention to provide a portable hand-held screw driving tool that accepts a flexible collated strip of screws of a longer length, such as in the range of 2–4 inches (or longer) and which are heavier than shorter 1–2 inch screws, in which a slidable guide accepts the collated strip through a slot or pathway on the guide member that is mounted on the upper portion of the tool, and which guides the collated strip toward the front or nose portion of the tool at a driving position, and which directs the flexible collated strip of screws to a slide body sub-assembly that indexes the individual screws toward the driving position, all the while keeping the screws from becoming substantially misaligned, e.g., from substantially bunching, tangling, or sagging.

Additional advantages and other novel features of the invention will be set forth in part in the description that follows and in part will become apparent to those skilled in the art upon examination of the following or may be learned with the practice of the invention.

To achieve the foregoing and other advantages, and in accordance with one aspect of the present invention, a movable guide apparatus is provided for use with a portable fastener-driving tool, wherein the fastener-driving tool exhibits: (i) a housing having a first end and a second end, and a wall member therebetween; and (ii) a fastener driving mechanism proximal to the first end of the housing, for receiving a collated strip of fasteners and moving a fastener of the collated strip of fasteners to a driving position; and in which the movable guide comprises: an elongated member having a third end and a fourth end, the elongated member being positioned proximal to the wall member of the tool's housing, the third end being proximal to the first end of the housing, and the fourth end extending toward the second end of the housing; the elongated member including a longitudinal pathway having an entry area proximal to the fourth end and an exit area proximal to the third end, the collated strip of fasteners being received at the entry area and then directed through the pathway toward the exit area, the collated strip of fasteners being directed from the exit area toward the fastener driving mechanism; and the elongated member being in a movable mechanical communication with the wall member of the housing, and in a fixed mechanical communication with the fastener driving mechanism.

In accordance with another aspect of the present invention, a portable fastener-driving tool is provided, which comprises: (a) an elongated housing containing a prime mover device, the housing having a first end and a second end, and a wall member therebetween; (b) a fastener driving mechanism proximal to the first end of the housing; and (c) a movable guide member having a third end and a fourth end, the third end being proximal to the first end of the housing, the guide member including a guiding pathway for a collated strip of fasteners, the guiding pathway having an exit area at the third end; wherein the guide member is in a movable mechanical communication with the housing, and is in a fixed mechanical communication with the fastener driving mechanism.

Still other advantages of the present invention will become apparent to those skilled in this art from the following description and drawings wherein there is described and shown a preferred embodiment of this invention in one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description and claims serve to explain the principles of the invention. In the drawings:

DETAILED DESCRIPTION OF THE PREFERRED EMBODIMENT

Reference will now be made in detail to the present preferred embodiment of the invention, an example of which is illustrated in the accompanying drawings, wherein like numerals indicate the same elements throughout the views.

Figure 1:
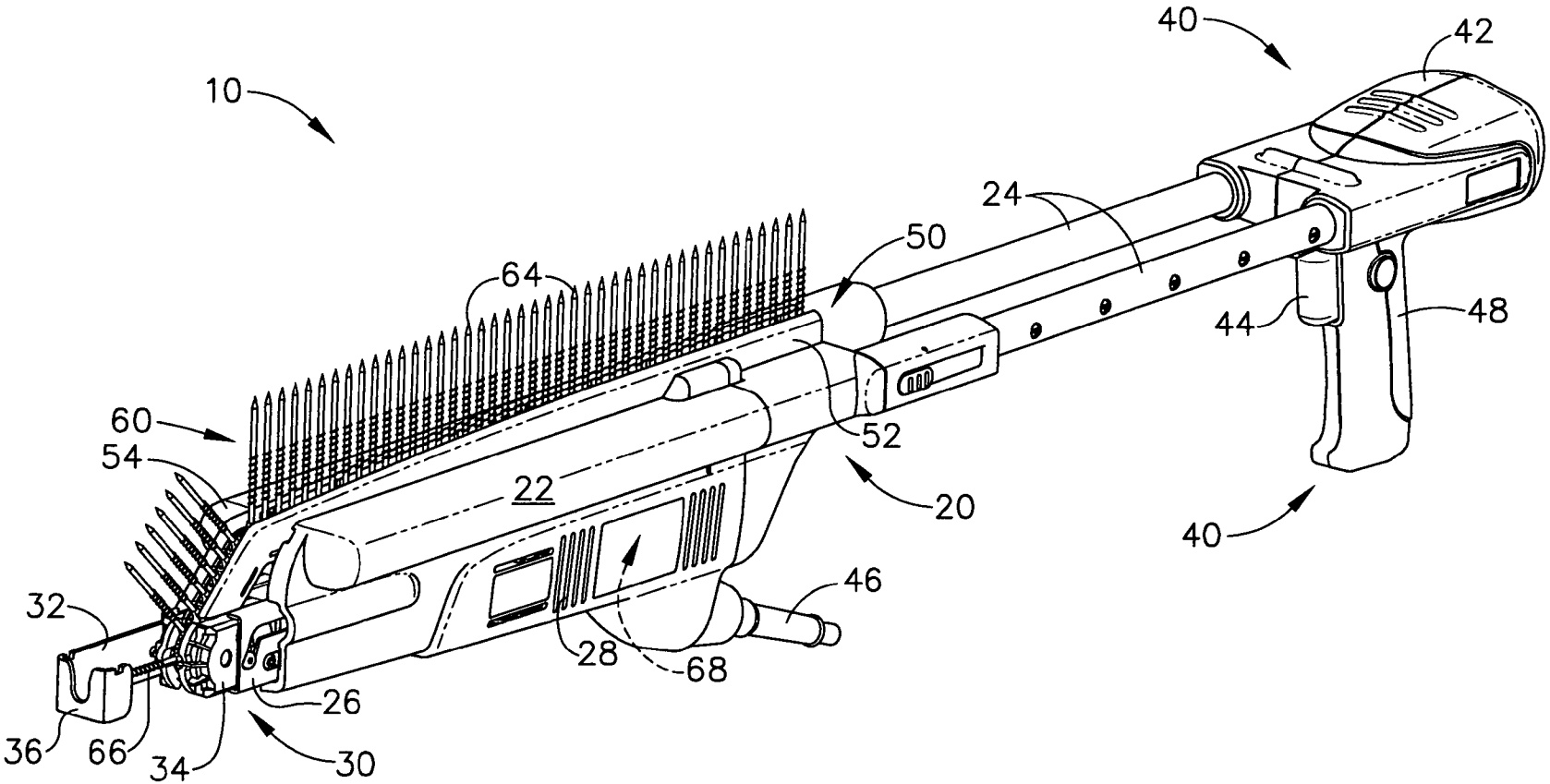
FIG. 1 is a perspective view from above and from the side-front quarter of a portable hand-held screw driving tool that accepts a flexible collated strip of screws from a top portion of the tool, as constructed according to the principles of the present invention.

Referring now to the drawings, FIG. 1 shows a portable screw driving tool, generally designated by the reference numeral 10, which has a housing portion 20, a front end portion 30 where the screws are driven into an object, and a handle portion 40. A slidable screw feed guide rail is generally designated by the reference numeral 50, and is slidably mounted to an upper area of the housing portion 20. The portable tool 10 is often used in a vertical orientation to drive screws downward into a floor surface, such as a patio deck. Since the tool 10 is often used to drive vertically downward, it has an adjustable height mechanism, which includes two connecting rods 24 that allow the handle portion 40 to have a variable distance from the housing portion 20.

The handle portion 40 has a pistol-type grip with a trigger 44, that mechanically actuates an electrical motor (not shown) that is inside the housing portion 20. The top area of the handle portion 40 includes a gripping surface 42, while a portion of the bottom surface of the rear extension and the rear portion of the handle itself have gripping surfaces, altogether at 48.

The housing portion 20 includes a front housing outer shell structure 22, which receives the adjustable length connecting rods 24. A fixed feed tube 26 is located at the front end of the outer shell structure 22. The front housing 22 comprises a surrounding wall member essentially throughout its length, and there are several ventilation slots 28 in its lower side wall portions. The feed tube 26 houses some of the movable portions of the tool 10 as discussed below. In the illustrated embodiment, feed tube 26 is fixedly attached to the internal mechanical mechanisms contained within housing portion 20, such as a motor, a gearbox, and a clutch (not shown).

The portable tool 10 includes an electric motor (not visible in FIG. 1) within the housing 22 as a prime mover device to actuate the fastener drive portions of the tool, and electrical power is provided through an electric cord 46. The prime mover device is generally designed by the reference numeral 68. Many of the internal "drive components" that include the prime mover device 68 of tool 10 are similar to those disclosed in a commonly-assigned companion patent application titled, "TENSIONING DEVICE APPARATUS FOR A BOTTOM FEED SCREW DRIVING TOOL FOR USE WITH COLLATED SCREWS," filed on Sep. 29, 2004, Ser. No. 10/953,422, which is assigned to Senco Products, Inc., and which is incorporated herein by reference in its entirety.

The front end portion 30 includes a movable nose piece 32, which is attached to a slide body sub-assembly 34. Both the nose piece 32 and slide body sub-assembly 34 are movable in a longitudinal direction of the tool 10, and when the nose piece 32 is pressed against a solid object such that it displaces linearly toward the rear, the screw driving tool 10 will be actuated to physically drive one of the screws into the solid object (also sometimes referred to herein as the "workpiece"). Nose piece 32 has a front surface 36, which preferably has a rough texture such as sandpaper, so that it will not easily slide while pressed against the surface of the workpiece when the tool is to be utilized. In the illustrated embodiment of FIG. 1, the nose piece 32 is detachable from the slide body sub-assembly 34 so that nose piece 32 can be re-positioned for different lengths of screws. The nose piece 32 has a plurality of screw length positioning holes 38 (see FIG. 3), which are used to attach nose piece 32 to the slide body sub-assembly 34 at different relative positions to one another.

Much of the mechanical mechanisms described above for the portable screw driving tool 10 have been available in the past from Senco Products, Inc., including such tools as the Senco Model Nos. DS200-D4 and DS300-D2. These earlier tools may not have had the precise same construction as described above in reference to FIG. 1, but there are certainly some similarities.

At the upper areas of the front housing 22 is a guide "rail" device to direct a strip of collated screws toward the front portion of the tool 10. This "guide rail" structure is referred to herein as a screw feed guide rail 50, which includes a left rail half 52 and a right rail half 54. Further details of this screw feed guide rail 50 are described below, but in general for the present invention, the screw feed guide rail 50 is movable in the longitudinal direction of the tool 10, such that it can slide along a set of protrusions or tangs 82 and 84 (see FIGS. 6 and 7) at the same time the movable nose piece 32 and the slide body sub-assembly 34 are moved in that longitudinal direction. In this manner, the screw feed guide rail 50 and the slide body sub-assembly 34 are fixedly attached to one another, and this combination is slidably in mechanical communication with the housing portion 20. The tangs 82 and 84 provide a linear bearing surface against internal portions of the wall member that makes up the housing outer shell structure 22.

It will be understood that the tangs 82 and 84 could instead be included as part of the housing outer shell structure 22, rather than being included in the screw feed guide rail 50 as described above and illustrated herein, without departing from the principles of the present invention. In this alternative mode of the invention, the screw feed guide rail 50 would then have some type of recessed linear bearing surfaces to receive the tangs that would then protrude from the housing outer shell structure 22.

The main purpose of tool 10 is to drive screws that are provided in the form of a flexible collated strip sub-assembly that is generally designated by the reference numeral 60. The individual screws 64 are held in place by a flexible plastic strip 62. As can be seen in FIG. 1, this collated strip sub-assembly 60 can run along the entire length of the screw feed guide rail 50 from the rear area of the housing portion 20 toward the front end portion 30 of tool 10. The screws 64 are fed directly along the screw feed guide rail 50 within a guiding slot that is discussed below in greater detail. As the screws traverse through the slot portion of the screw feed guide rail 50, they are ultimately directed toward the front end of the tool until each of the screws reaches a "drive" position at 66. When viewing the tool 10 at its front-most portion (i.e., the left-hand portion as viewed in FIG. 1), the left-most screw 64 has been indexed to the drive position at 66, and thus is now essentially co-linear with the main drive components of the portable tool 10. As the collated screw sub-assembly 60 is moved through the screw feed guide rail 50, the plastic strip 62 will eventually make contact with a sprocket (not visible in FIG. 1) that acts as a rotary indexer, and which is located inside the slide body sub-assembly 34. The sprocket moves each of the portions of the plastic strip 62 into a proper rotary position so that their attached screws 64 eventually end up in the front-most drive position 66.

When the nose piece 32 is actuated by being pressed against a workpiece (not seen in FIG. 1), then a drive bit (not visible in FIG. 1) will move in a linear fashion to push the screw at 66 into the workpiece, and the drive bit will also then be turned in a rotary motion to twist the screw at 66 in the normal manner for driving a screw 64 into a solid object. Once the screw at 66 has been successfully driven into the solid object, then the tool 10 is withdrawn from the surface of the solid object, and of course the screw 64 remains behind and has now broken free from the plastic strip 62. In one mode of the invention, the tool 10 will now be free to allow the sprocket to perform its rotary indexing function and to bring forth the next screw 64 into the front-most drive position at 66. This type of screw-feed actuation can be referred to as "indexed on return," since the "lead screw" is moved into the "firing position" at 66 as the nose piece 32 is released (or "returned") from the surface of the workpiece.

The tool 10 can also be configured in an alternative screw-feed actuation mode, in which the lead screw is moved into the firing position at 66 as the nose piece 32 is pressed against the surface of a workpiece; this type of screw-feed actuation can be referred to as "indexed on advance." If tool 10 is configured for indexed on advance, then the lead screw would not yet be in the position at 66 (as seen on FIGS. 1, 2, and 4) at the moment the nose piece 32 is "relaxed" in its non-firing state. Instead, the lead screw is not indexed into the firing position at 66 until the nose piece 32 is "pushed in" (or "advanced") toward the main body portion of the tool 10 (e.g., toward the handle portion 40), which is a state of the tool illustrated in FIG. 5, and discussed below in greater detail. Note that the indexed on advance configuration is a preferred mode of operation for tool 10.

It will be understood that both the indexed on advance and indexed on return screw-feed actuation modes of operation can work equally well with the movable guide 50 of the present invention. Other possible modes of screw-feed actuation might be developed in the future that would also work well with the movable guide 50 of the present invention.

Figure 2:
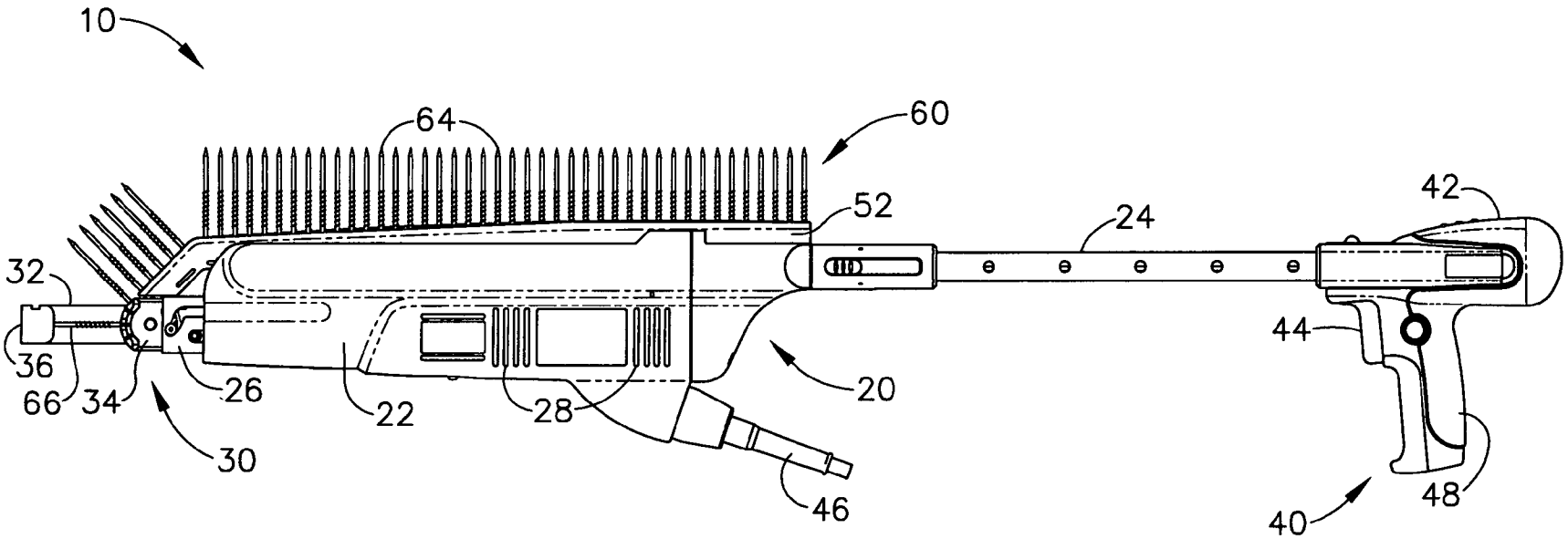
FIG. 2 is a side elevational view of the screw driving tool of FIG. 1.

Referring now to FIG. 2, the portable tool 10 is seen from its side, and the gripping surfaces 42 and 48 are seen as being relatively continuous along the back portion (to the right in the view of FIG. 2) of the tool 10. A human user will typically use both hands to hold the tool 10 in place while it is being actuated to drive a screw into an object. One of the user's hands can be placed on the top surface 42, while the other user's hand can grasp the handle portion 40 at the lower gripable surface 48, while also actuating the trigger 44.

Figure 3:
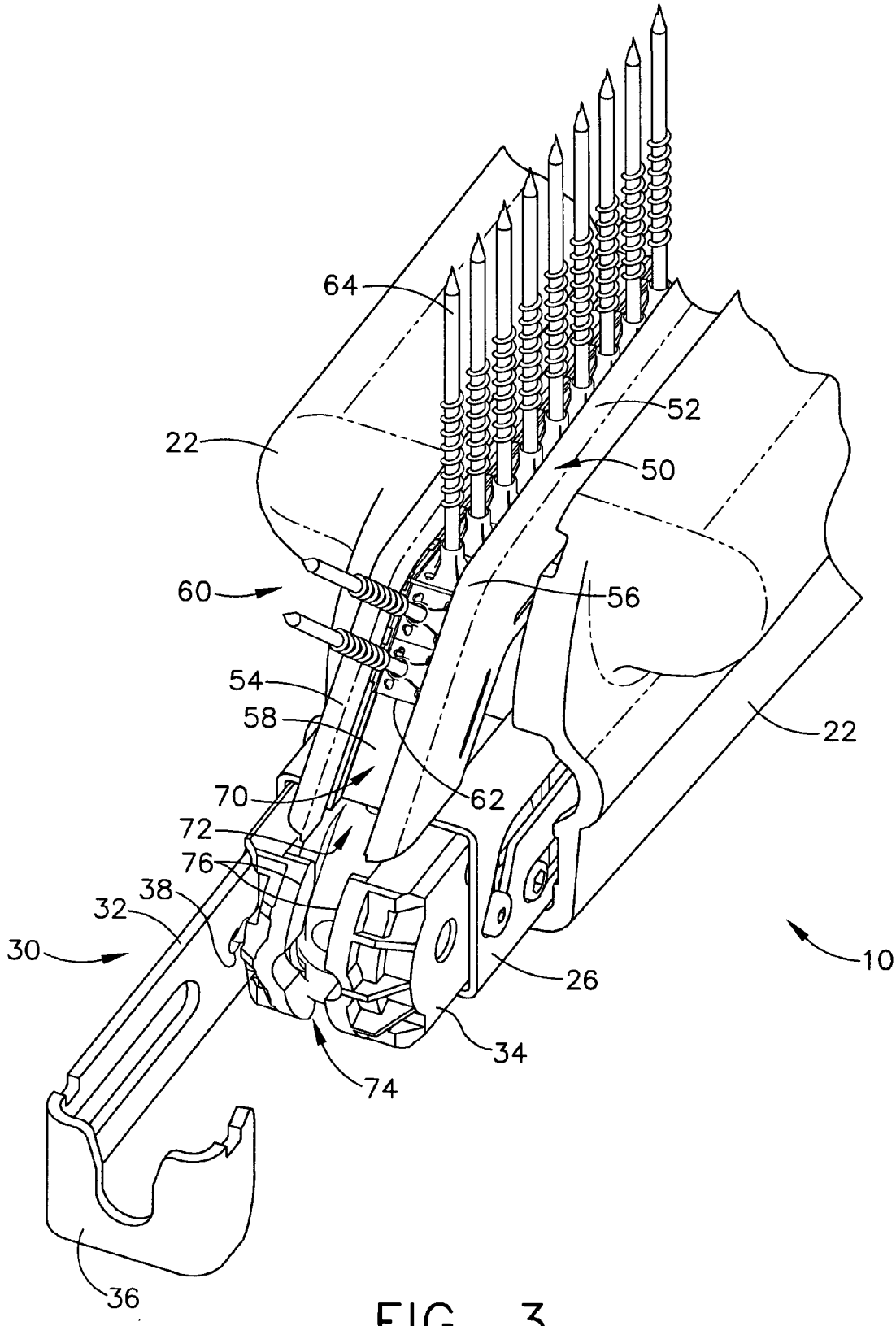
FIG. 3 is a perspective view from above and mainly the front of the screw driving tool of FIG. 1, showing further details of the screw driving tool in which the collated strip of screws is not extended all the way to the front driving position of the tool.

Referring now to FIG. 3, the front end portion 30 of the tool is illustrated in greater detail, so that some of the features of the slidable screw feed guide rail 50 can be seen. In FIG. 3, the collated strip sub-assembly 60 is only partially loaded into the screw feed guide rail 50, so that the details of the front portions of the guiding rail 50 can be better seen. As can be seen in FIG. 3, the collated strip sub-assembly 60 has the flexible plastic strip 62 indexed up to a front portion of the slidable screw feed guide rail 50, just past a bend 56 in the screw pathway of the screw feed guide rail 50. A wear plate 54 is included within the open area (e.g., a slot) through which the collated strip 60 passes, as the strip 60 approaches the front open area 70 that is the end of the guiding pathway through which the screws pass in the screw feed guide rail 50. The "delivery" area of the screw guide pathway is indicated at 72, and as the flexible plastic strip 62 exits along the wear plate 58, it then encounters the slide body sub-assembly 34, and the plastic strip 62 continues along an open area (or slot) 74 in the slide body sub-assembly 34. The slide body sub-assembly 34 includes a pair of guide surfaces 76 that guide the shank of the individual screws 64 as they pass along the slide body sub-assembly 34, as they are being indexed toward the front-most "drive" position at 66.

Figure 4:
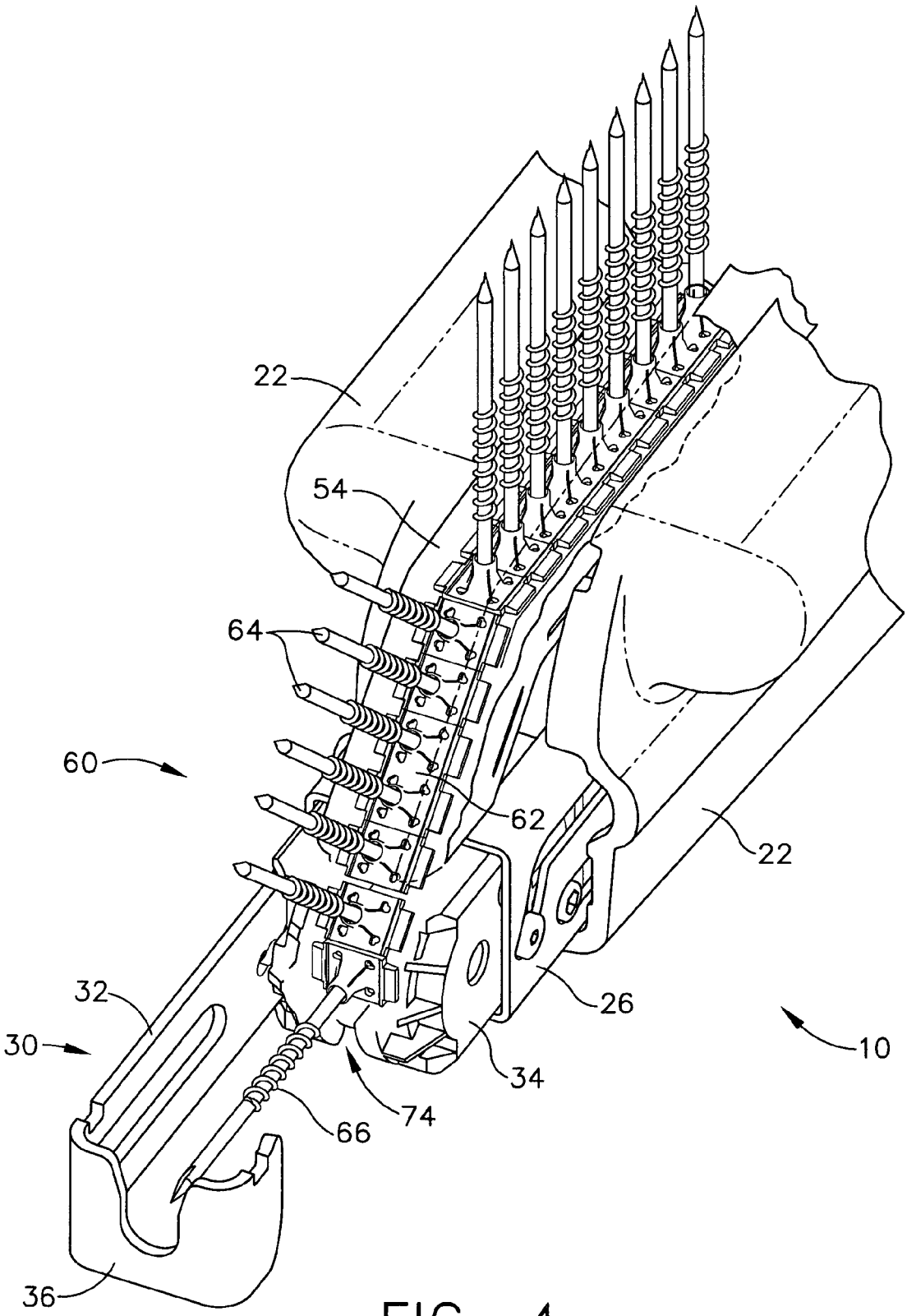
FIG. 4 is a perspective view from above and the front-side quarter of the screw driving tool of FIG. 1, showing the screw driving tool as the collated strip of screws extends all the way to the front "driving" position at the nose of the tool, in which the tool is in its relaxed, non-firing state.

In FIG. 4, the collated strip sub-assembly 60 has now been indexed all the way to the front of the tool 10, such that its furthest-most screw 64 has been indexed to the drive position 66. The individual segments of the plastic strip 62 are visible in FIG. 4, since a portion of the "left" rail half 52 is partially cut-away in this view. The screw at 66 will be driven through the opening in the front surface 36 of the movable nose piece 32. In FIG. 4, it can be seen that the collated strip sub-assembly 60 will hold the screws 64 in place while the lead screw at 66 will be driven into a solid workpiece, which occurs when the movable nose piece 32 is pushed against the workpiece surface. When that occurs, nose piece 32 will be pushed toward the upper-right corner in FIG. 4, and the slide body sub-assembly 34 as well as the screw feed guide rail 50 will all move in accordance with this movement of the nose piece 32. This keeps the collated screw sub-assembly 60 in a relatively intact and non-movable position with respect to the sliding guide rail 50, and thus the system will tend to keep the screws 64 from becoming misaligned during the firing procedure of the tool 10.

Figure 5:
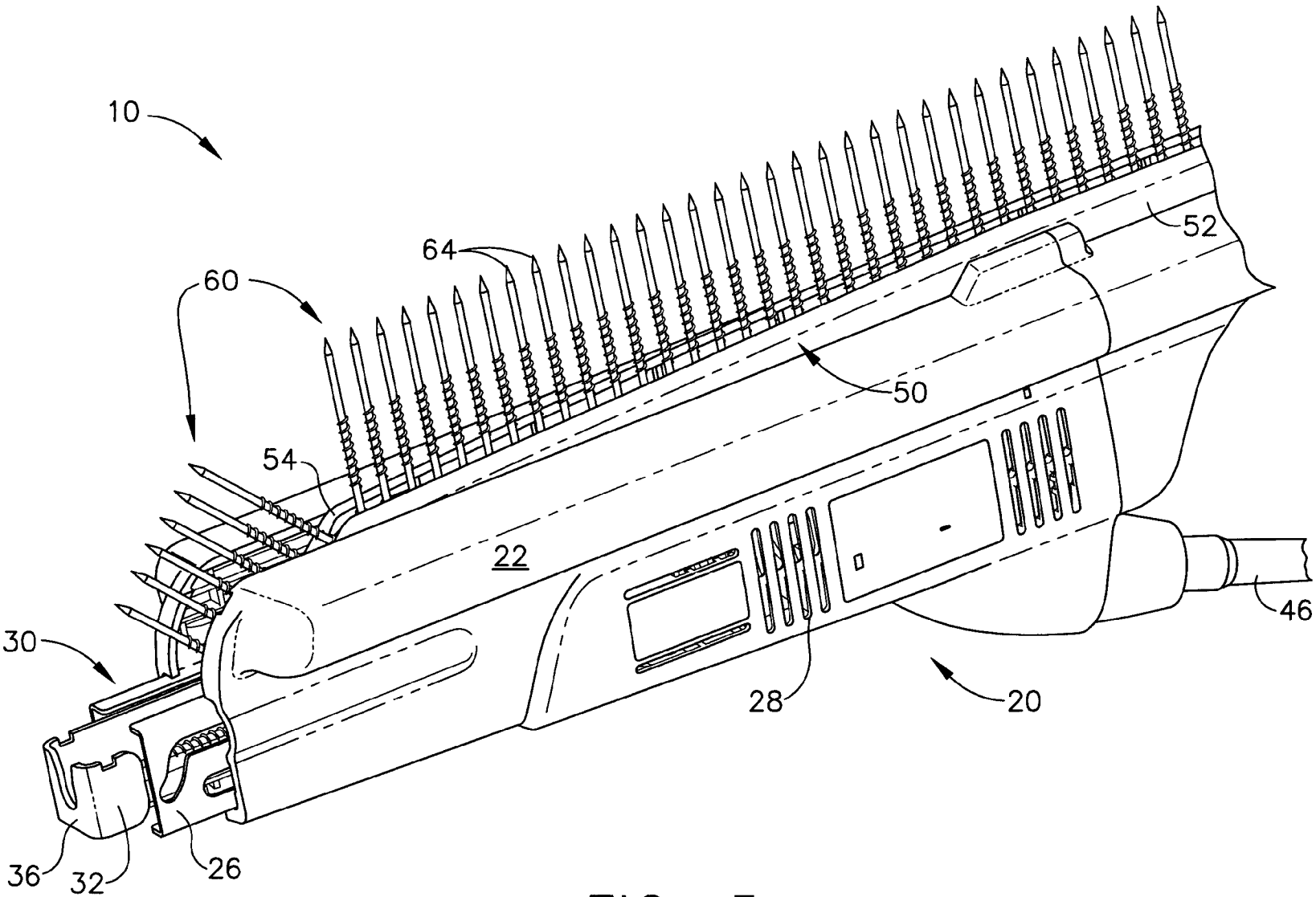
FIG. 5 is a perspective view from the side and slightly above the screw driving tool of FIG. 1, showing the nose piece in its actuated "firing" position, and also showing the sliding guide rail in its actuated position, in which the actuated position is the "firing" position of the tool.

FIG. 5 illustrates the firing position in which the movable nose piece 32 has been depressed with respect to the overall housing portion 20. The entire guide rail 50 and collated screw sub-assembly 60 have also been moved back (which is toward the upper-right area in FIG. 5). The slide body sub-assembly 34 is not visible in FIG. 5, because it is now behind the feed tube 26 and front housing outer shell structure 22.

Figure 6:
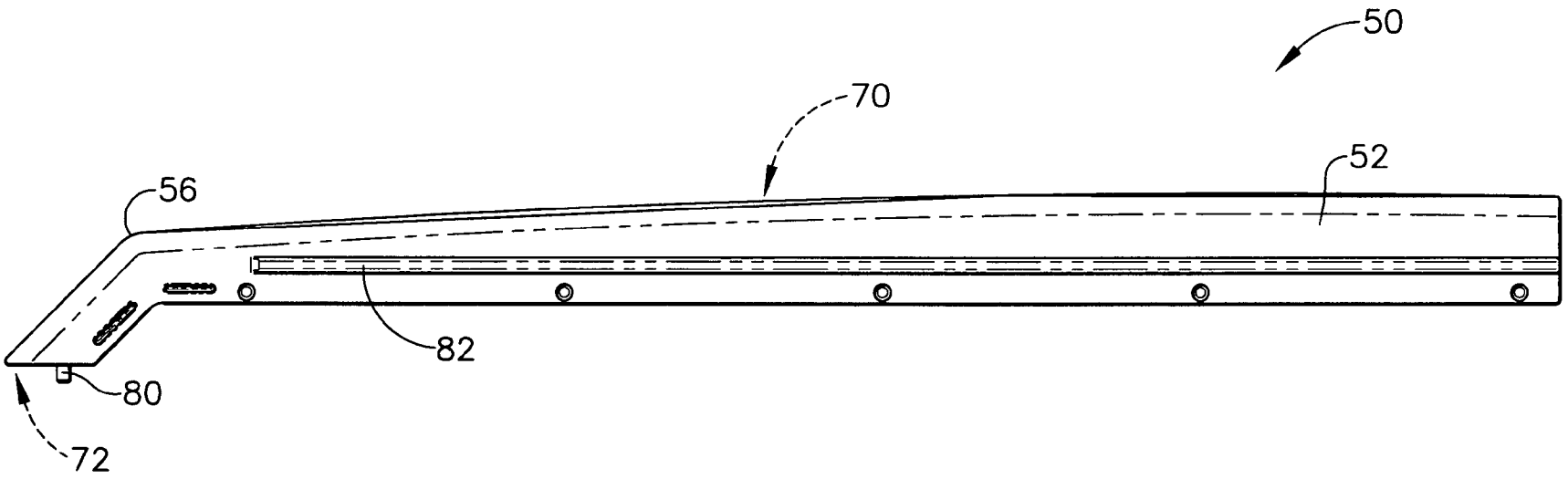
FIG. 6 is a side elevational view of the sliding guide rail that mounts to the upper portion of the tool of FIG. 1.

Referring now to FIG. 6, the slidable guide rail 50 is illustrated in a side view, to show some of the construction features thereof. The "left" rail half 52 is visible since it is facing the viewer, and the protrusion or tang 82 is now visible. The screw feed guide rail 50 includes a mounting pin 80 that is positioned within an opening of the slide body sub-assembly 34 when the guide rail 50 is attached to the tool 10. The bend or elbow 56 is readily seen in FIG. 6. Reference numeral 70 refers to the guiding pathway (or slot) through which the collated strip of screws moves.

Figure 7:
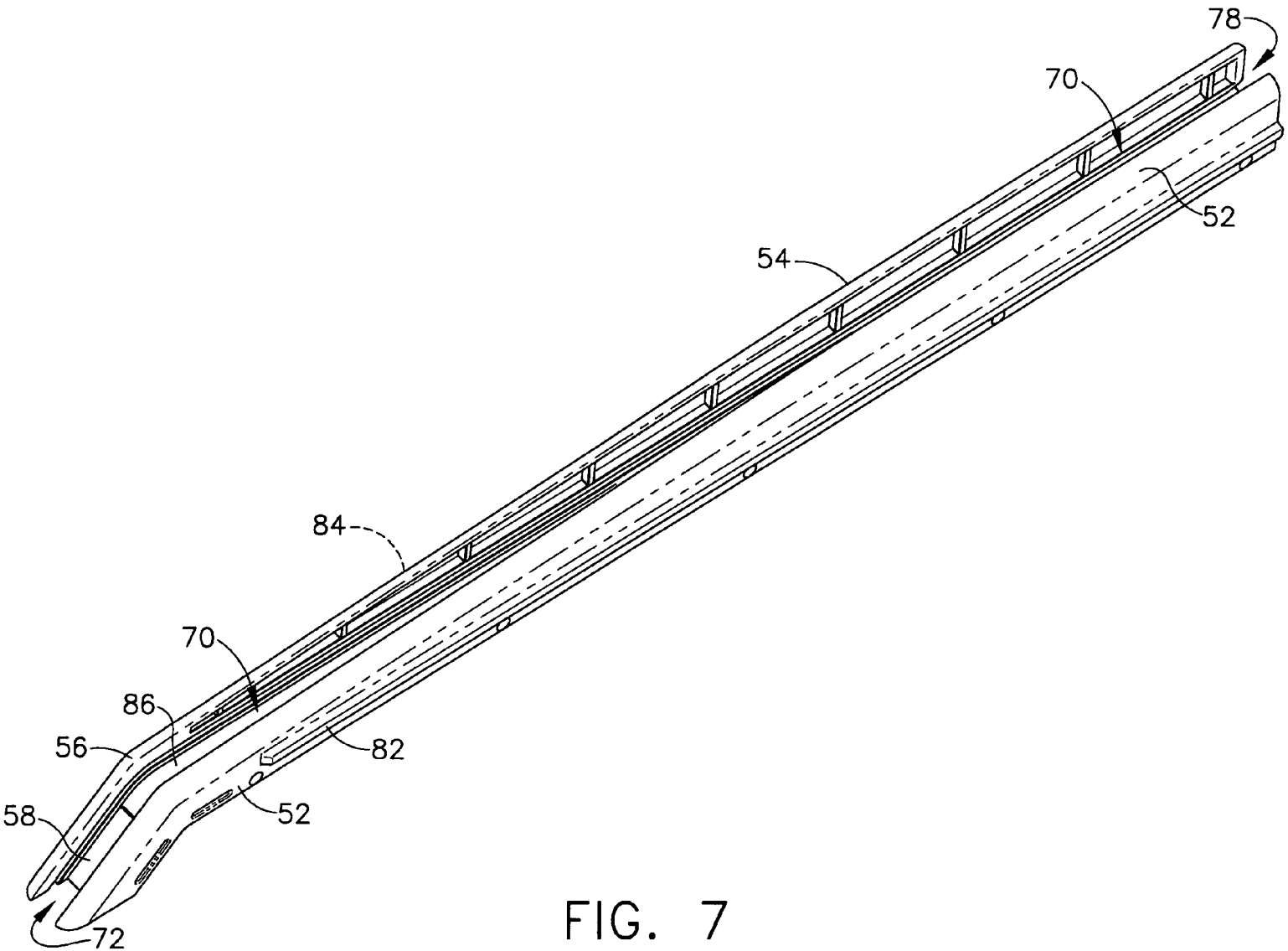
FIG. 7 is a perspective view from above and the side-front quarter of the slidable guide rail that mounts to the upper portion of the tool of FIG. 1.

Referring now to FIG. 7, some of the other features of the screw feed guide rail 50 are visible, including the "front" delivery end of the guiding pathway or slot at 72, as well as a "rear" entry end of the same slot at 78. The "left" tang 82 is visible as it protrudes from the left rail half 52. A "right" tang 84 is visible from the inside of the "right" rail half 54. The wear plate 58 is visible, and is adjacent to a bottom slide surface 86 that is formed as part of the guiding pathway or slot that starts at the rear entry end 78 and exits at the front delivery end 72 of the guide rail 50. The protrusions or tangs 82 and 84 slide along a pair of interior linear slots (not shown on FIG. 7) within the front housing 22 of the tool 10.

By inspecting the figures hereof, it can be seen that the collated screw sub-assembly 60 will be well retained within the guiding slotted areas (i.e., the pathway) of the slidable screw feed guide rail 50, and the exit end (or delivery end) at 72 will guide the flexible plastic strip 62 and deliver that plastic strip directly to the slide body sub-assembly 34. This keeps the screws 64 from becoming tangled or bunched, or otherwise becoming misaligned during the operation of the tool 10.

In one configuration of the present invention, a plurality of small arcuate protrusions (not visible in the figures) are provided along at least a portion of the guiding pathway (or slotted area) 70 of the slidable screw feed guide rail 50. These protrusions can increase the mechanical resistance against the side edges of the flexible plastic strip 62, and thereby help prevent this strip 62 from too easily advancing along the slot or pathway 70. The larger the fasteners (e.g., screws) 64 that are part of the collated strip 60, the more likely that the increased weight of these larger fasteners will tend to push one of the fasteners of the collated strip 60 past the front indexing position; if that occurs, then a fastener may not stop at the correct position (i.e., at the firing position 66), and such fastener might push past the firing position 66 and remain in the flexible plastic strip 62. Of course, that would be an undesirable result.

The arcuate protrusions can be made in several different forms (i.e., they don't necessarily need to be arcuate), and can even be movable, if desired, to act as movable detent guide positioning devices. In one mode of the present invention, the arcuate protrusions are located along both sides of the slot/pathway 70, and are positioned between the elbow 56 and the entry area at 78. These protrusions (or "bumps") can be manufactured as part of a molded plastic guide rail half (e.g., one of the halves 52 or 56), and they can extend throughout the entire slot/pathway 70, or for only a portion of this slot/pathway, if desired.

It will be understood that the principles of the present invention are applicable to many different types of fastener driving tools, including tools powered by AC electrical power (e.g., 120 VAC line power from an outlet), DC electrical power (e.g., from a battery or a solar panel), a pneumatic power source, or a hydraulic power source, for example. In other words, the prime mover device 68 could comprise an electric motor, a pneumatic motor, or a hydraulic motor, for example. In addition, the types of fasteners that can be driven in the manner of the present invention are not limited to screws, but could instead be nails or rivets, for example.

Some of the components used in the present invention have been disclosed in a commonly-assigned patent, titled "Screw Feed and Driver for a Screw Driving Tool, U.S. Pat. No. 5,988,026, which is assigned to Senco Products, Inc., and which is incorporated herein by reference in its entirety. Some portions of the present invention have also been disclosed in another commonly-assigned patent, titled "Screw Driving Tool," U.S. Pat. No. Des. 462,001, which is assigned to Senco Products, Inc., and which is incorporated herein by reference in its entirety.

It will be understood that the term "collated screw sub-assembly" as used herein refers to a strip of screws that are temporarily mounted in a flexible strip of material that exhibits openings and other structures to hold the screws in place until they are needed. In many products, the flexible strip of material comprises plastic, but other materials could be used, if desired. The individual screws are advanced to a driving position in a screw driving tool (such as portable tool 10), and each screw is individually driven from the flexible strip by the tool when the tool is actuated.

It will also be understood that the principles of the present invention are applicable to many different types of fastener driving tools, including tools powered by AC electrical power (e.g., 120 VAC line power from an outlet), DC electrical power (e.g., from a battery or a solar panel), a pneumatic power source, or a hydraulic power source, for example. In addition, the types of fasteners that can be driven in the manner of the present invention are not limited to screws, but could instead be nails or rivets, for example.

All documents cited in the Detailed Description of the Invention are, in relevant part, incorporated herein by reference; the citation of any document is not to be construed as an admission that it is prior art with respect to the present invention.

The foregoing description of a preferred embodiment of the invention has been presented for purposes of illustration and description. It is not intended to be exhaustive or to limit the invention to the precise form disclosed. Any examples described or illustrated herein are intended as non-limiting examples, and many modifications or variations of the examples, or of the preferred embodiment(s), are possible in light of the above teachings, without departing from the spirit and scope of the present invention. The embodiment(s) was chosen and described in order to illustrate the principles of the invention and its practical application to thereby enable one of ordinary skill in the art to utilize the invention in various embodiments and with various modifications as are suited to particular uses contemplated. It is intended to cover in the appended claims all such changes and modifications that are within the scope of this invention.

The invention claimed is:

1. A movable guide for use with a portable fastener-driving tool, wherein the fastener-driving tool exhibits: (i) a housing having a first end and a second end, and a wall member therebetween; and (ii) a fastener driving mechanism proximal to said first end of the housing, for receiving a collated strip of fasteners and moving a fastener of the collated strip of fasteners to a driving position;

said movable guide comprising:

an elongated member having a third end and a fourth end, said elongated member being positioned proximal to the wall member of said tool's housing, said third end being proximal to said first end of the housing, and said fourth end extending toward said second end of the housing;

said elongated member including a longitudinal pathway having an entry area proximal to said fourth end and an exit area proximal to said third end, said collated strip of fasteners being received at said entry area and then directed through said pathway toward said exit area, said collated strip of fasteners being directed from said exit area toward said fastener driving mechanism; and said elongated member being in a movable mechanical communication with said wall member of the housing, and in a fixed mechanical communication with said fastener driving mechanism.

2. The movable guide as recited in claim 1, wherein said movable guide is slidably mounted to said wall member at an upper portion of the housing.

3. The movable guide as recited in claim 2, wherein said movable guide exhibits at least one linear protrusion in said elongated member that is in mechanical communication with at least one mating linear recess in said wall member, such that said at least one linear protrusion slides along said at least one mating linear recess.

4. The movable guide as recited in claim 2, wherein said movable guide exhibits at least one linear recess in said elongated member that is in mechanical communication with at least one mating linear protrusion in said wall member, such that said at least one linear protrusion slides along said at least one mating linear recess.

5. The movable guide as recited in claim 1, wherein said collated strip of fasteners slides through guide surfaces of the longitudinal pathway in said elongated member, between said entry area proximal to said exit area.

6. The movable guide as recited in claim 5, wherein said guide surfaces prevent the collated strip of fasteners from becoming substantially misaligned while traveling through the pathway.

7. The movable guide as recited in claim 6, wherein said guide surfaces prevent the collated strip of fasteners from substantially (a) sagging, (b) bunching, and (c) becoming tangled.

8. The movable guide as recited in claim 5, wherein said guide surfaces include: (a) first guide surfaces that comprise two halves for directing a movement of a flexible member of said collated strip of fasteners therethrough, and (b) second guide surfaces for directing a movement of shanks of the fasteners therethrough, of said collated strip of fasteners.

9. The movable guide as recited in claim 1, wherein said fasteners comprise screws.

10. The movable guide as recited in claim 9, wherein said screws exhibit a length of at least two inches.

11. The movable guide as recited in claim 1, wherein said fastener driving mechanism includes a fastener indexing portion, comprising a slide body with a rotatable sprocket.

12. The movable guide as recited in claim 11, further comprising: a movable nose piece of said fastener driving mechanism that moves, along with said slide body, in a substantially linear direction when a fastener is driven, and said movable guide moves along with said nose piece and slide body;

wherein said collated strip of fasteners does not become substantially misaligned during said movement of the nose piece, slide body, and movable guide, including when in the fastener driving position.

13. The movable guide as recited in claim 11, wherein said movable guide includes a locating pin that mounts into a mating recess in said slide body.

14. A movable guide for use with a portable fastener-driving tool wherein the fastener-driving tool exhibits: (i) a housing having a first end and a second end, and a wall member therebetween; and (ii) a fastener driving mechanism proximal to said first end of the housing, for receiving a collated strip of fasteners and moving a fastener of the collated strip of fasteners to a driving position;

said movable guide comprising:

an elongated member having a third end and a fourth end said elongated member being positioned proximal to the wall member of said tool's housing, said third end being proximal to said first end of the housing, and said fourth end extending toward said second end of the housing;

said elongated member including a longitudinal pathway having an entry area proximal to said fourth end and an exit area proximal to said third end, said collated strip of fasteners being received at said entry area and then directed through said pathway toward said exit area, said collated strip of fasteners being directed from said exit area toward said fastener driving mechanism;

said elongated member being in a movable mechanical communication with said wall member of the housing, and in a fixed mechanical communication with said fastener driving mechanism; and an extendable handle that is attached at said second end of the housing.

15. A portable fastener-driving tool, comprising:

(a) an elongated housing containing a prime mover device, said housing having a first end and a second end, and an elongated wall member therebetween, said housing having a longitudinal axis between said first and second ends, and said wall member of the housing including a pair of elongated recesses running substantially parallel to said longitudinal axis; (b) a fastener driving mechanism proximal to said first end of the housing; and (c) a movable guide member having a third end and a fourth end, said third end being proximal to said first end of the housing, said guide member including a guiding pathway for a collated strip of fasteners, said guiding pathway having an exit area at said third end, and said guide member includes a pair of elongated protrusions running substantially parallel to said longitudinal axis of the housing, such that said pair of protrusions substantially mate with said pair of elongated recesses of the wall member of the housing;

wherein said guide member is in a slidable movable mechanical communication with said housing using said elongated protrusions along said elongated recesses, and is in a fixed mechanical communication with the fastener driving mechanism.

16. The tool as recited in claim 15, wherein said fourth end extends toward said second end of the housing.

17. The tool as recited in claim 16, wherein said guiding pathway is in a substantially longitudinal direction with respect to the tool.

18. The tool as recited in claim 17, wherein said guiding pathway further exhibits an entry area proximal to said fourth end, wherein a collated strip of fasteners is received at said entry area and then directed through said guiding pathway toward said exit area, and wherein said collated strip of fasteners is contained within said guiding pathway in a manner that prevents the strip from becoming substantially misaligned while traveling through the pathway.

19. The tool as recited in claim 15, wherein said fastener driving mechanism includes a fastener indexing portion that receives a collated strip of fasteners and moves a fastener of the collated strip of fasteners to a driving position of said fastener driving mechanism.

20. The tool as recited in claim 19, wherein said fastener indexing portion comprises a slide body with a rotatable sprocket.

21. The tool as recited in claim 20, further comprising: a movable nose piece of said fastener driving mechanism that is proximal to said fastener indexing portion, wherein said nose piece moves, along with said slide body, in a substantially linear direction when a fastener is driven, and wherein said guide member moves along with said nose piece and slide body.

22. The tool as recited in claim 21, wherein said collated strip of fasteners does not become substantially misaligned during said movement of the nose piece, slide body, and guide member, including when in the fastener driving position.

23. The tool as recited in claim 20, wherein said guide member includes a locating pin that mounts into a mating recess in said slide body.

24. The tool as recited in claim 15, wherein a collated strip of fasteners slides through guide surfaces of the guiding pathway in said guide member, between an entry area proximal to the fourth end, and said exit area.

25. The tool as recited in claim 24, wherein said guide surfaces prevent the collated strip of fasteners from becoming substantially misaligned while traveling through said pathway.

26. The tool as recited in claim 24, wherein said guide surfaces prevent the collated strip of fasteners from substantially (a) sagging, (b) bunching, and (c) becoming tangled.

27. The tool as recited in claim 24, wherein said guide surfaces include: (a) first guide surfaces that comprise two halves for directing a movement of a flexible member of said collated strip of fasteners therethrough, and (b) second guide surfaces for directing a movement of shanks of the fasteners therethrough, of said collated strip of fasteners.

28. The tool as recited in claim 15, wherein said fasteners comprise screws.

29. The tool as recited in claim 28, wherein said screws exhibit a length of at least two inches.

30. A portable fastener-driving tool comprising:

(a) an elongated housing containing a prime mover device, said housing having a first end and a second end, and a wall member therebetween: (b) a fastener driving mechanism proximal to said first end of the housing: (c) a movable guide member having a third end and a fourth end, said third end being proximal to said first end of the housing, said guide member including a guiding pathway for a collated strip of fasteners, said guiding pathway having an exit area at said third end; and (d) an extendable handle that is attached at said second end of the housing;

wherein said guide member is in a movable mechanical communication with said housing and is in a fixed mechanical communication with the fastener driving mechanism.

* * * * *

UNITED STATES PATENT AND TRADEMARK OFFICE

CERTIFICATE OF CORRECTION

PATENT NO. : 7,082,857 B1
APPLICATION NO. : 10/964099
DATED : August 1, 2006
INVENTOR(S) : William H. Hoffman It is certified that error appears in the above-identified patent and that said Letters Patent is hereby corrected as shown below:

Claim 14
In column 11, line 1, insert -- , -- (fomma) after “fourth end”.

Claim 15
In column 11, line 39, insert -- , -- (comma) after “slidable”.

Claim 30
In column 12, line 47, delete “:” (colon) and insert -- ; -- (semicolon).

In column 12, line 49, delete “:” (colon) and insert -- ; -- (semicolon).

In column 12, line 57, insert -- , -- (comma) after “housing”.

Signed and Sealed this

Fourteenth Day of November, 2006

JON W. DUDAS
*Director of the United States Patent and Trademark Office*